US006421940B1

(12) United States Patent
Cobb et al.

(10) Patent No.: US 6,421,940 B1
(45) Date of Patent: Jul. 23, 2002

(54) END CLIP AND RELATED SIGN APPARATUS

(75) Inventors: Ronald W. Cobb, Atlanta; Benjamin H. Bell, Avondale Estates, both of GA (US)

(73) Assignee: APCO Graphics, Inc., Atlanta, GA (US)

( * ) Notice: Subject to any disclaimer, the term of this patent is extended or adjusted under 35 U.S.C. 154(b) by 0 days.

(21) Appl. No.: 09/532,378

(22) Filed: Mar. 21, 2000

Related U.S. Application Data

(60) Provisional application No. 60/131,248, filed on Apr. 27, 1999.

(51) Int. Cl.[7] ..... G09F 7/02

(52) U.S. Cl. ..... 40/611; 40/622; 24/67.3; 248/222.12

(58) Field of Search ..... 40/611, 620, 622, 40/658; 248/222.12, 223.41; 24/67 R, 67.3

(56) References Cited

U.S. PATENT DOCUMENTS 3,168,954 A * 2/1965 Herrmann ..... 24/67 R
4,310,135 A 1/1982 Dobson
4,318,528 A 3/1982 Dobson
4,344,244 A * 8/1982 Tyke ..... 40/611
4,523,402 A 6/1985 Dobson
4,779,369 A * 10/1988 Hill et al. ..... 40/611
5,152,490 A * 10/1992 Deutsch ..... 40/341 X
5,307,581 A * 5/1994 Kalmykow ..... 40/611
5,343,646 A * 9/1994 Cobb et al ..... 40/622 X
5,613,874 A * 3/1997 Orlando et al. ..... 40/611 X

* cited by examiner

*Primary Examiner*—Brian K. Green
(74) *Attorney, Agent, or Firm*—Kilpatrick Stockton LLP

(57) ABSTRACT

A directory sign assembled from individual modular sign plates, and an improved mounting clip for supporting the sign plates in assembly. The mounting clips have multiple sets of prongs spaced so that prongs of separate sets engage mounting flanges of one or more sign plates. The mounting flanges extend back from the front face of the sign plates to conceal the prongs and related attachment structure, and the end mounting clips have bases that conceal the ends of the sign plates.

1 Claim, 11 Drawing Sheets

END CLIP AND RELATED SIGN APPARATUS

CROSS-REFERENCE TO RELATED APPLICATION

This application claims the benefit of U.S. Provisional Application No. 60/131,248, filed Apr. 27, 1999.

TECHNICAL FIELD

This invention relates in general to signs, and relates in particular to directory signs having one or more sign plates supported on a mounting structure.

BACKGROUND OF THE INVENTION

It is known in the prior art to provide signs assembled from one or more individual sign plates supported by mounting clips. This sign construction is particularly useful for directory signs, as the construction permits removing and replacing an individual sign plate without disturbing other sign plates assembled to provide an overall directory sign. The mounting clips may be attached to a backing member which, in turn, is mounted on a wall or another surface for supporting the sign, although the mounting clips alternatively may be attached directly to the wall or supporting surface.

U.S. Pat. Nos. 4,310,135; 4,318,528; and 4,523,402 show examples of sign construction in which a sign plate is supported by a mounting clip. However, some disadvantages have been found with signs constructed according to those prior-art teachings. For example, one sign construction requires a mounting clip configured to accommodate a sign plate only of a predetermined width i.e., the dimension transverse to the longitudinal extent of the sign plate. Sign plates having a width greater or lesser than that of a particular sign plate-mounting clip construction thus are not readily interchangeable within a particular directory sign, unless that sign also incorporates multiple mounting clips to accommodate sign plates of different widths. Another prior-art sign does provide mounting clips to accommodate plural sign plates having diverse widths, but requires that the sign plates at the top and the bottom of an assembled directory sign have edges of unequal depth, with the longer edge extending rearwardly to conceal the otherwise-exposed ends of the mounting clips. This arrangement requires manufacturing and stocking two kinds of sign plates for each width, namely, end sign plates having edges of unequal depth and intermediate plates having equal-depth edges for attachment to the mounting clips intermediate the upper-end and lower-end sign plates.

The sign constructions of the prior art also require mounting or supporting the mounting clips with so-called side trims, typically extrusions or other structures designed to cover the exposed ends of the sign plates, for cosmetic purposes and also to inhibit tampering with the assembled signs. This requirement for separate side trims further increases the costs of manufacturing the sign elements, and requires maintaining an inventory of side trims suitable for assembling complete signs.

SUMMARY OF THE INVENTION

Stated in general terms, a sign according to the present invention has one or more sign plates supported by mounting clips configured to receive sign plates at predetermined modular locations along the length of each mounting clip. Each mounting clip may support several sign plates of the same modular width or height, or may support sign plates of mixed width correlated with the attaching elements of the mounting clips. The mounting clips in one preferred embodiment include an integral end member that covers and conceals the end of each sign plate attached to the mounting clip, thereby providing a sign of finished appearance without requiring any frame or closure elements other than the sign plates and mounting clips.

Stated somewhat more particularly, each mounting clip according to the present invention has a plurality of elements for removably attaching sign plates to the mounting clip. A pair of mounting flanges extends back from the sides of the mounting plates, and those flanges engage complementary prongs of a mounting clip. Those prongs are formed as part of plural plate-engaging elements of the mounting clip, with each such element in the preferred embodiment having a pair of prongs. However, the spacing between the adjacent fingers of a plate engaging element is substantially less than the distance between the flanges of a sign plate, so that one or more plates of engaging elements fits between the flanges. The spacing between adjacent plate engaging elements is a modular submultiple of the spacing between confronting flanges of a sign plate, so that one flange engages a prong on one side of a plate engaging element and the other flange of that sign plate will engage a prong on the opposite side of a different plate engaging element on the mounting clip. At least one, and usually several, disused plate engaging elements thus typically are interposed between the plate engaging flanges of a particular sign plate. Those disused plate engaging elements allow repositioning the sign plate by the pitch or spacing between adjacent elements, a distance that is a fraction of the spacing between the flanges of the sign plate.

The present invention also includes a modified mounting clip received in end plates at the ends of the sign. These end plates include a trim element that fits over and closes the ends of sign plates supported by the modified mounting clips, so that the mounting clips need not include a unitary closure for covering the ends of the sign plates.

The mounting clips of the present invention can accommodate sign plates of various design and width, including plates with a flat surface as well as plates defining a slot for inserting message strips. The modular nature of the mounting clips can accommodate sign plates of different lengths and elevations, so that a sign plate of relatively great width for displaying graphics may be combined with a sign including relatively narrow sign plates bearing other kinds of information. Further yet, the mounting clips can support other kinds of message elements such as a holder for temporarily displaying papers notes or messages. An embodiment of such a message holder is disclosed.

DETAILED DESCRIPTION OF PREFERRED EMBODIMENTS

Figure 1:
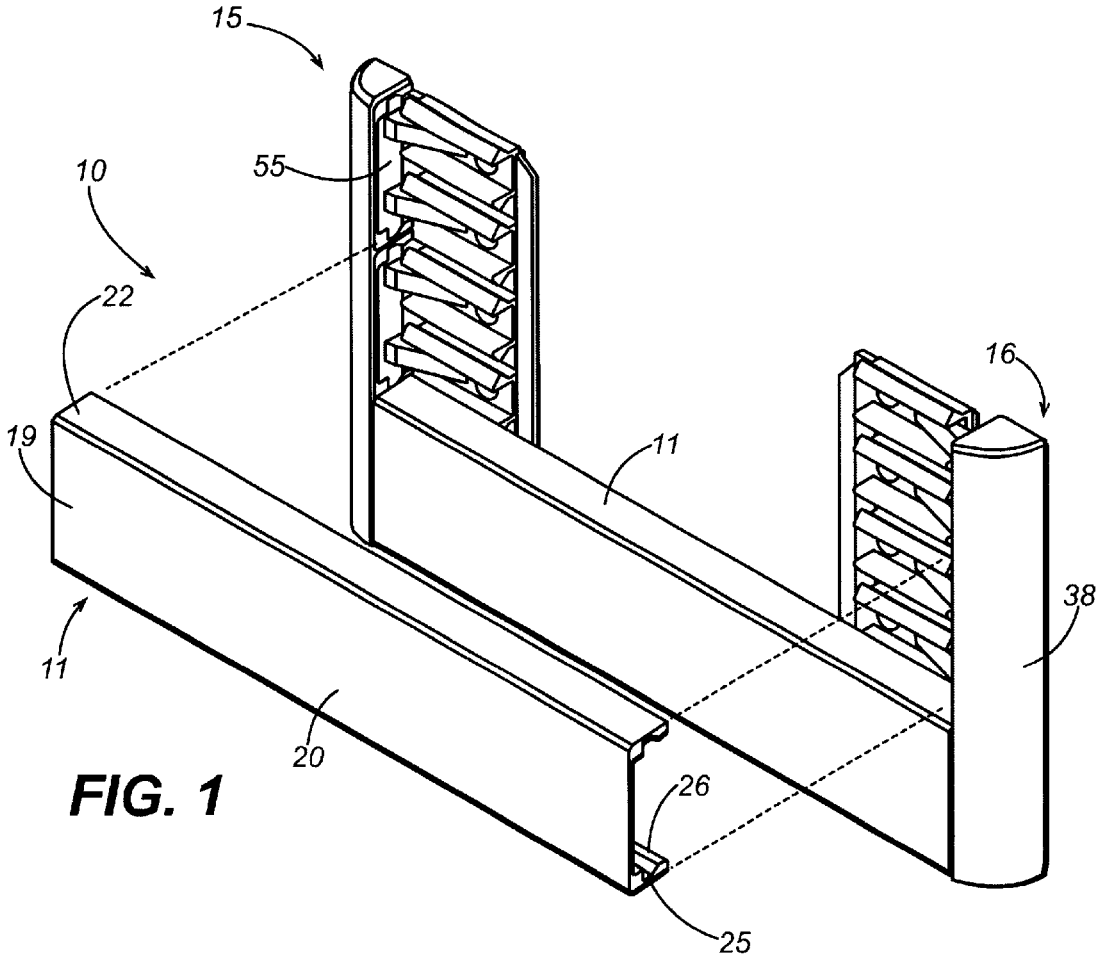
FIG. 1 is an exploded view showing a directory sign according to a first preferred embodiment of the invention.

Referring now to the drawings, in which like numerals indicate like elements throughout the several views, FIG. 1 shows a sign indicated generally at 10 and including two separate sign plates 11 supported by the multiple end clips 15 and 16. The multiple end clips 15 and 16 are spaced apart from each other to define opposite sides of the sign 10, and those end clips are fastened to a surface such as a base 9. The base 9 may be part of a wall or other existing surface to which the assembled elements of the sign 10 are affixed, or may be a separate member mountable on the wall or other surface. It should be understood that the length of each multiple end clip 15 and 16 in a complete sign according to the present invention may be lesser or greater than as shown in elevation in FIG. 1, so as to support more than or less than the number of sign plates shown therein or as few as a single sign plate.

Figure 1C:
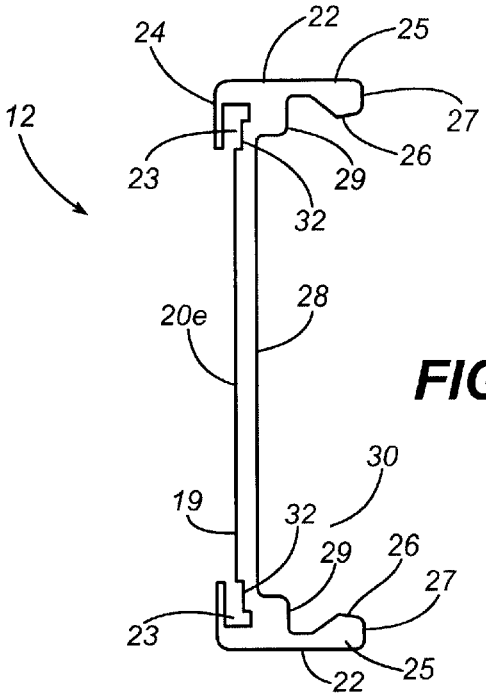
FIG. 1C is an end view of a modified sign plate for the embodiment of FIG. 1.
Figure 1A:
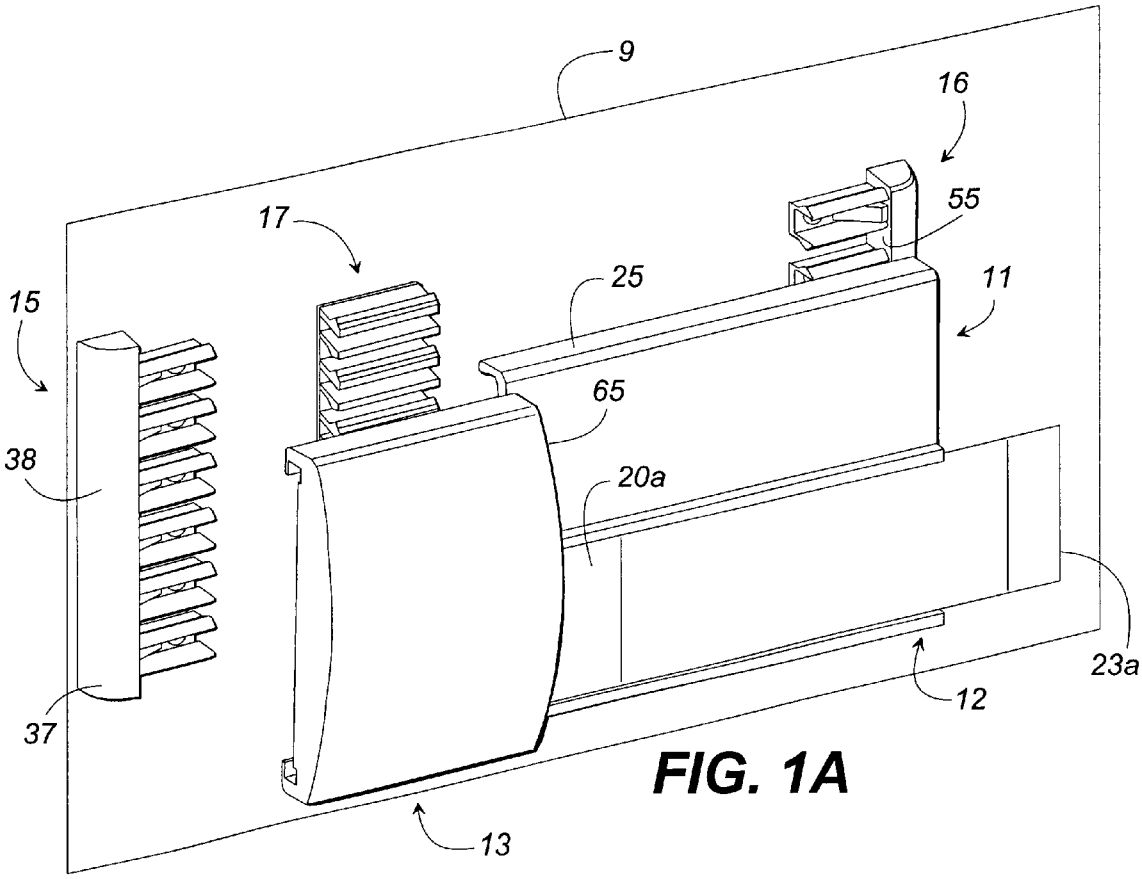
FIG. 1A is an exploded fragmentary view showing a directory sign according to a first modification of the embodiment in FIG. 1.

Two disclosed embodiments of sign plates according to the present invention are the sign plate 11 having a plain outer indicia-receiving surface 20 as shown in FIG. 1 and 1A, and the sign plate 12 having a recessed outer surface 20*a* as shown in FIGS. 1A and 1C. The front of either sign plate is defined by a central web 19 having an outer surface 20 or 20*a* extending between front corners 21 at the sides 22 of the sign plate. Those front corners 21 in the sign plate 12 protrude forwardly from the outer surface 20*a* and terminate with outer lips 24 that extend inwardly toward each other a short distance in front of the outer surface, thereby defining slots 23 facing each other along the length of the sign plate at each side of the outer surface. These slots 23 accept the slideable insertion of a message strip 23*a*, (FIG. 1A), or the like along the surface 20*a* of the sign plate 12.

Both sides of the surface 20*a* on the sign plate 12 are indented to form recessed regions 32 along the length of that surface. Those recessed regions assist in inserting a message strip 23*a* onto the surface 20*a* and help provide a more uniform coating of the surface during fabrication of the sign plate 12.

Each side 22 of the sign plate 12 has a flange 25 extending back from the central web 19. The flanges 25 are of equal depth behind the underside 28 of the central web 19, and the back edge 27 of each flange has a longitudinal rib 26 extending the length of the flange. The ribs 26 extend inwardly from the back edges 27 of the flanges to face each other in spaced-apart relation beneath the underside 28 of the central body forming the sign plate, so that the flanges and ribs define an open longitudinal channel 30 extending beneath the sign plate.

A land 29 is formed along each edge of the underside 28, on the back of the central web 19 of the sign plate. These lands 29 extend downwardly from the underside 28 but stop well short of the ribs 26 adjacent the back edges 27 of the flanges. The purpose of the lands 29 is discussed below.

The sign plate 11 differs from the sign plate 12 by lacking the protruding front edges 21 and having a smooth outer surface 20 without the insertion slots 23. However, the sign plate 11 includes the sign flanges 25 with ribs 26 and other structure as shown in FIG. 1C with regard to the sign plate 12.

The sign plate 13 shown in FIG. 1A likewise includes side flanges and ribs as described above. However, the width of the sign plate 13 between the side flanges is a multiple of the corresponding width for each sign plate 11 and 12 also shown in FIG. 1A, such that the sign plate 13 can display a graphic or other information common to the messages or other information displayed on the separate sign plates 11 and 12. The extent of that width multiple depends on the design of the end clips 15–16, and the intermediate clip 17, as described below.

Figure 2A:
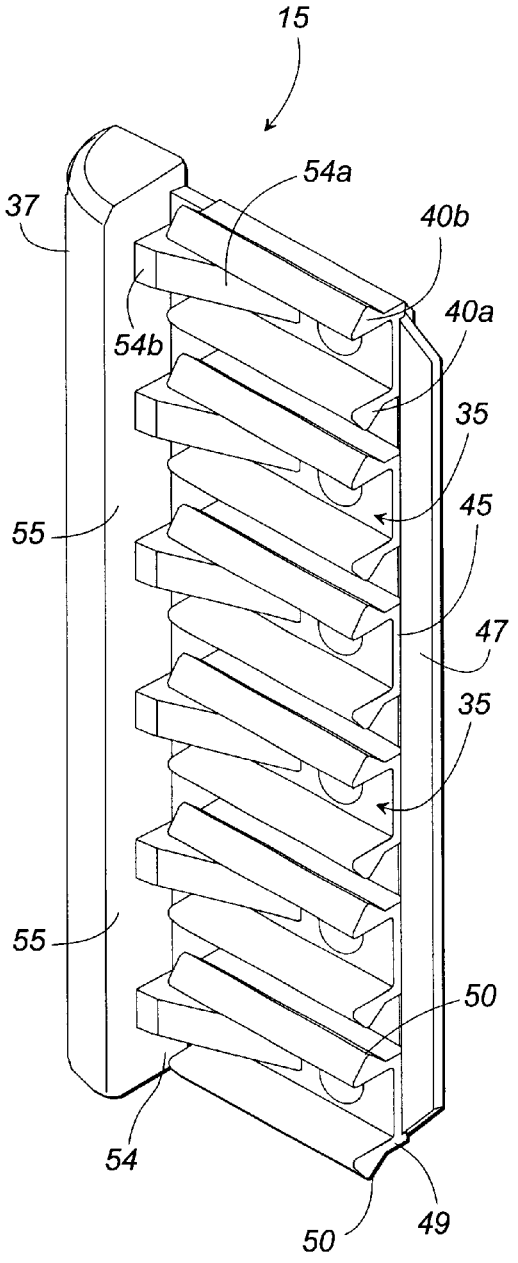
FIG. 2A is an isometric view of an end clip in the signs shown in FIG. 1.
Figure 2B:
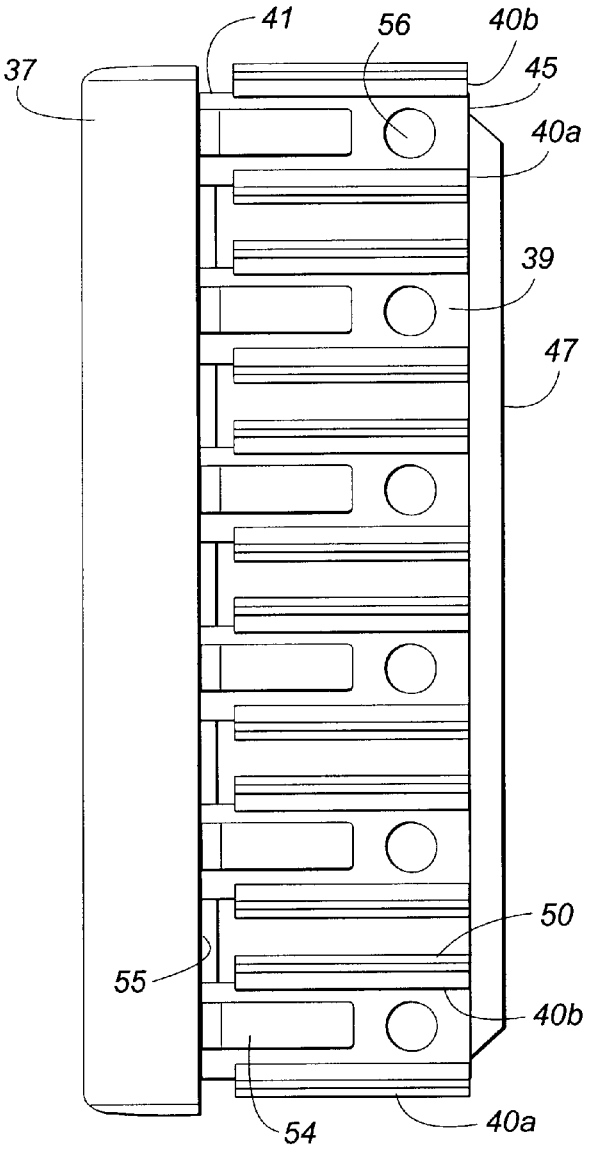
FIG. 2B is a front view of the end clip shown in FIG. 2A.
Figure 2C:
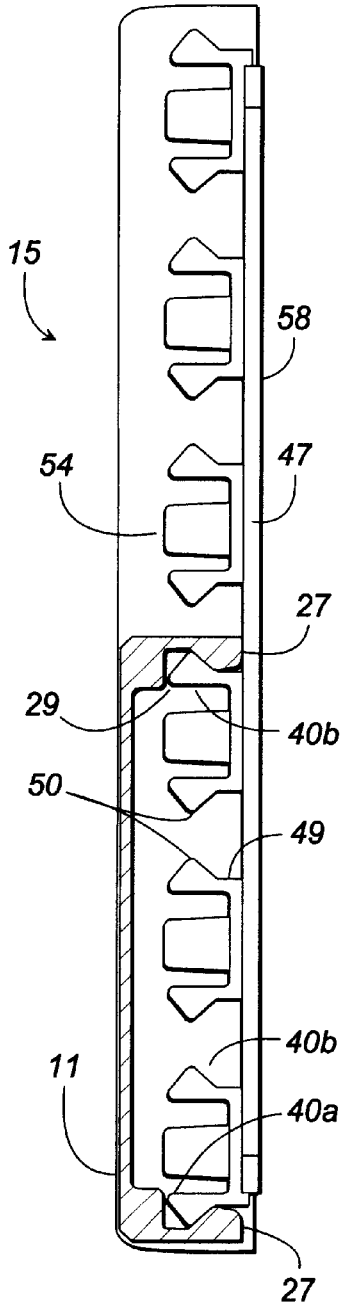
FIG. 2C is a sectioned view of the end clip shown in FIG. 2A, with a sign plate as shown in FIG. 1C attached to the end clip.

The end clips 15 and 16 of the disclosed embodiment are identical in structure and function, and only one such clip is described in detail. Each end clip has a side trim 37 extending lengthwise in a direction parallel to the widths of the sign plates supported by the end clips, so that the inner face 55 of each side trim abuts and covers the ends of the sign plates. Each end clip also has a multiple number of individual clip modules 35, each end clip having a pair of prongs 40*a*, 40*b*. The end clips 15 and 16 shown in FIGS. 1, 2A, and 2B each have six individual clip modules. The number of clip modules 35 on each end clip (or, on the multiple intermediate clip 17 described below) is not a critical feature, although it is preferred that each multiple clip have an even number of such modules. The clip modules 35 extend perpendicularly from an edge of the side trim 37 at regular intervals along the length of the side trim. The clip modules 35 are configured to fit between the opposed flanges 25 on the underside of a sign plate attached to the multiple end clip, as best seen in FIG. 2C. Each end clip preferably is a unitary article formed of an appropriate plastic material by injection molding.

Each pair of prongs 40*a*, 40*b*, extends up from opposite sides of a base 39 that extends outwardly from the side trim 37, where the inner end 41 of each base joins the side trim at or near the bottom of the side trim. The outer end 45 of each base 39 is connected to an end strip 47 extending parallel to the side trim 37. The end strip 47 maintains the predetermined separation between adjacent prongs 40*a*, 40*b* of the clip modules and provides structural rigidity for the end clip.

Each prong 40*a*, 40*b* of a clip 35 module joins the base 39 at a relatively thin longitudinal region 49, FIG. 2C, permitting the prongs to undergo elastic bending movement relative to the base sufficient to accommodate attachment or removal of a sign plate as described below. The prongs extend upwardly from the thin region 49, and the upper edge of each prong has a longitudinally-extending enlarged rib 50 formed on the side of the prong facing outwardly from the base 49. Each rib 50 preferably has upper-facing and lower-facing, inclined surfaces in the disclosed embodiment having a profile shape resembling a sidewise V, best seen in FIG. 2C, for ease of attaching and removing a sign plate. The prongs 40*a*, 40*b*, extend along the base 39 toward the side trim 37 but stop short of the side trim, as best seen in FIG. 2B, so that the prongs remain able to bend relative to the base 39 as described above.

The base 39 of each clip 35 module also is attached to the edge of the side trim 37 by a gusset 54 between the prongs 40*a*, 40*b* of the module. Each gusset extends from the upper surface of the base 39 to the inner face 55 of the side trim, as best seen in FIG. 2A. The gussets 54 in the disclosed embodiment have the profile of a ramp 54*a* extending upwardly from the base 39 to join a horizontal surface 54*b* at an elevation approximately in line with the inner ends of the prongs 40*a*, 40*b*, and from there extend to join the facing side 55 of the side trim 37. However, it should be understood that the particular shape of the gussets 54 is not a critical limitation. The gussets are integral with the side trim and the bases 39 of the clip modules, and provide structural stiffening of the overall end clip to prevent vertical deflection of the individual clip modules 35 when attaching or removing a sign plate.

Figure 2D:
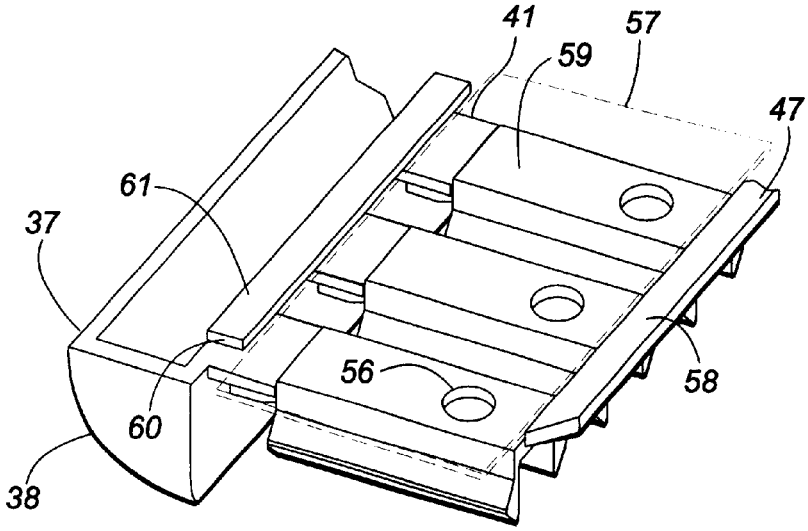
FIG. 2D is a fragmentary isometric view showing the back of the mounting clip shown in FIG. 2A.
Figure 2E:
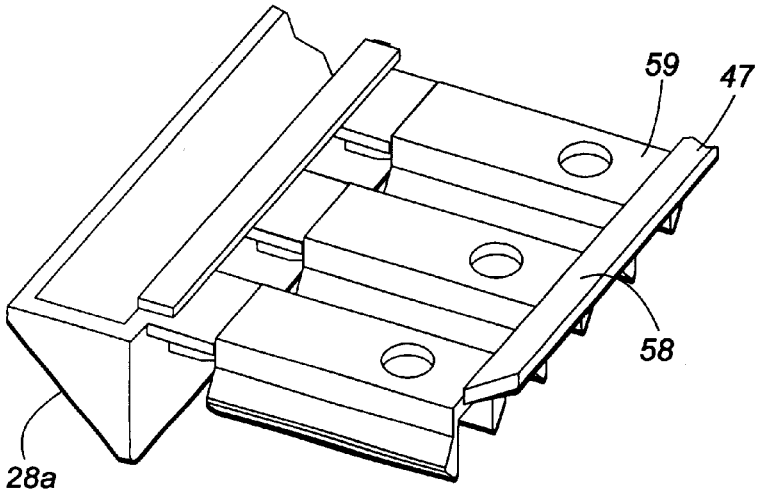
FIG. 2E is a view as in FIG. 2D, showing an end clip with an alternative side trim according to the present invention.

A hole 56 is formed through each base 39 to enable fastening the end clip to the base 9 (FIG. 1A) on which the sign elements are mounted. Alternatively, a suitable double-sided adhesive tape 57 may be to affix the multiple end clips, and one or more multiple intermediate clips 17 if appropriate, to a subsurface. To keep the sign plates separated from the outward face of such adhesive tape, the lower surface 58 of the end strip 47 at the outer end modules 35 on each end clip extends slightly below the bottom surfaces 59 of the bases 39, as shown in FIGS. 2D and 2E. An inner end strip 60 having a bottom surface 61 extends across the end clip at the inner ends of the bases 39, parallel to the end strip 47 and coplanar with the bottom 59 of the end strip. The tape 57 is placed between the end strips 47 and 60, adhering on one side to the bottom 59 of each base 39 and on the other side to the base 9. The thickness of the outer end strip 47 and of the inner end strip 60 providing the bottom surfaces 58 and 61, and the elevation of the prongs 40*a*, 40*b* and of the flanges 25 of the sign plates engaged by those prongs, is chosen so that the back edge 27 of each flange engages the upper surfaces of the outer end strip and the inner end strip. This arrangement is best seen in FIG. 2C. The end strips thus maintain the back edges 27 of the sign plates spaced apart a short distance from the undersides 58, 61, of the end strips, and thus spaced outwardly from the adhesive surface of the tape 57 used to attach the multiple end clips to a surface or wall. This spacing-apart of the sign plates from the adhesive tape keeps the sign plates from inadvertently becoming stuck to the tape, which would hinder removing the sign plates from the end clips.

Assembling a sign 10 in its simplest form according to the present invention is now discussed. A pair of multiple end clips 15 and 16 are mounted in parallel spaced-apart relation to each other, preferably although not necessarily on a flat plate or other support that, in turn, will be attached to an area of use such as a wall or the like. The spacing between the confronting inner faces 55 of the end clips is substantially equal to the desired length of the sign plates making up the sign 10, and that length is determined by the message or other indicia intended for the outer surfaces 20 of the sign plates.

The lateral spacing between the flanges 25 of each sign plate 11 is an integer multiple of the pitch or spacing between adjacent clip modules 35 of the multiple end clips, plus the lateral distance between the prongs 40*a*, 40*b* of an individual module. Put differently, the width of each individual clip module 35 and the pitch of those modules along the end clips is chosen, with regard to the lateral spacing between the flanges 25, so that one flange of a sign plate engages a first prong 40*a* on one side of a particular clip module while the other flange of the same sign plate engages a second prong 40*b* of another clip module along the multiple end clip. In FIG. 2C of the illustrated embodiment, the flanges 25 of the sign plate 11 engage the prong 40*a* of the first clip module and the prong 40*b* of another clip module twice removed from the first module, leaving an intermediate (and disused) clip module between the flanges of the sign plate. The lateral spacing between the flanges 25 of a particular sign plate, together with the width of each individual clip module and the pitch of adjacent modules along the multiple end clips, determine the number of those modules spanned by a particular sign plate. Thus, any particular sign plate may be repositioned on the assembled sign by a minimum distance equal to the pitch between adjacent clip modules. Similarly, a sign having multiple end clips of a particular modular dimension can accommodate sign plates having a variety of widths, i.e., lateral spacing between flanges 25 of the sign plates, so long as those widths are modular multiples of the pitch and width of the modules.

When the sign plates are attached to the multiple end clips, the lands 29 on the underside of the central web 19 contact the upper ends of the prongs 40*a* and 40*b*. This arrangement is best seen in FIG. 2C. This contact between the lands 29 and the upper ends of the prongs keeps the back edges 27 of the flanges 25 from extending behind the end strip 47 and the inner end strip 60, so as to keep the back edges out of contact with an adhesive tape 57 mounting the end clips in assembly.

Returning to FIG. 1, it should now be understood that a sign according to the present invention may require only the multiple end clips 15 and 16, without an intermediate clip 17 as shown in FIG. 1A. In that case, the sign 10 can support sign plates only of the same length as defined by the spacing between the two multiple end clips, for example, the sign plate 11 extending between multiple end clips 15 and 16. Each end of the sign plates confronts and is covered by the inner face 55 of the corresponding end clip, thereby providing a visually attractive closure for the ends of the sign plates and also framing both sides of the assembled sign. The outer surface 38 of the side trim 37 for each multiple end clip may be a quarter-round shape as best shown in FIGS. 1 and 2D, or alternatively may be beveled as shown at 28*a* in FIG. 2E or otherwise contoured to provide different aesthetic appearances. The upper flange 25 of the uppermost sign plate 11 and the lower flange of the lowermost sign plate in the complete sign 10 are visible and close the upper and lower ends of the assembled sign, eliminating the requirement for sign plates having dissimilar sides or some other structure for closing the top and bottom in the assembled sign. A complete directory sign according to the present invention thus may be assembled using only two different components, namely, sign plates (such as the plates 11, 12, or 13) of equal length and end clips (the end clips 15 and 16 being identical and thus usable for both ends of the sign).

To assemble a sign with sign plates of two or more different widths, as shown in FIG. 1A, at least one multiple intermediate clip 17 is positioned between the two multiple end clips for alignment with the intermediate end 65 of the relatively wide sign plate 11 and the intermediate ends 66 of the two relatively narrow sign plates 11 and 12. Details of the intermediate clips 17 are described below. The wide sign plate 13 then is attached to the multiple end clip 15 and the intermediate clip 17, and the two narrow sign plates are attached to that multiple intermediate clip and to the multiple end clip 16 at the other side of the sign. The wide sign plate 13 is twice the width of the individual sign plates 11 and 12 in the illustrated example, and so the flanges 25 of the wide sign plate span twice as many clip modules 35 of the end clip 15 and the intermediate clip 17 as does each individual narrower sign plate.

Figure 3A:
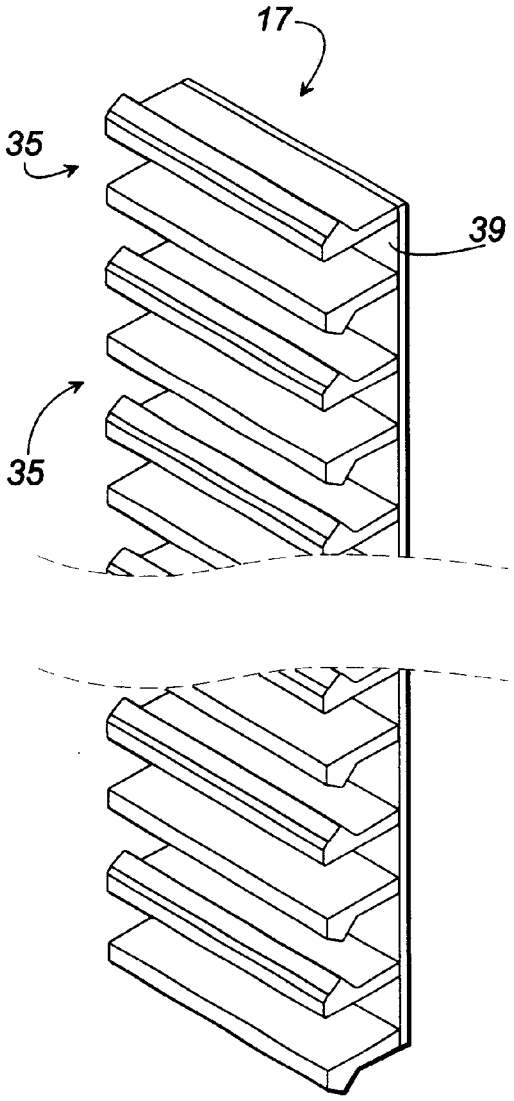
FIGS. 3A, 3B, and 3C, are respectively an isometric view, a front view, and a side view, each broken to show indeterminate length, of an intermediate mounting clip according to the embodiment of FIG. 1A.
Figure 3B:
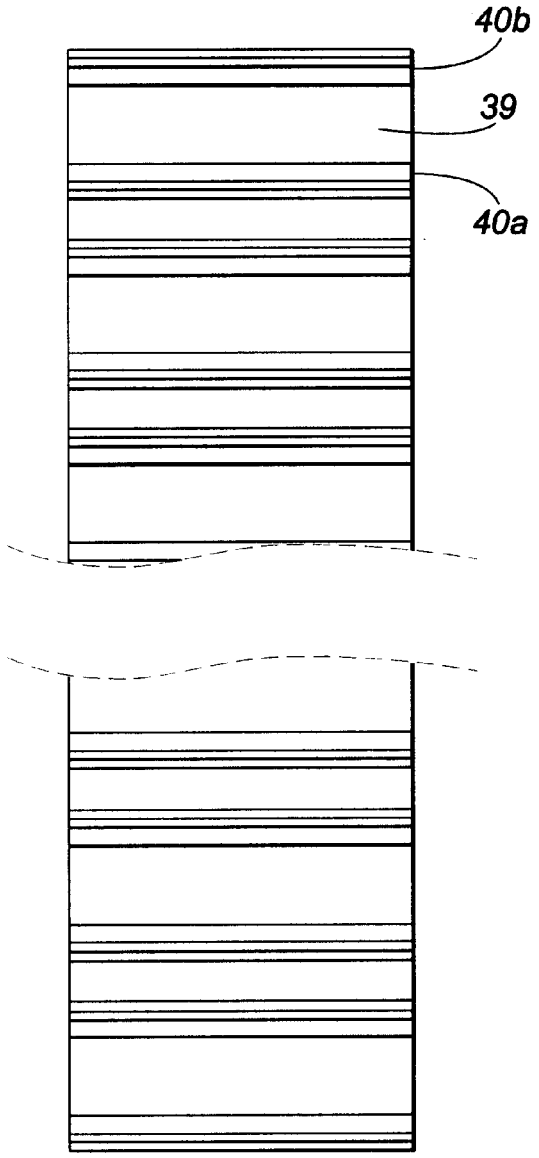
Figure 3C:
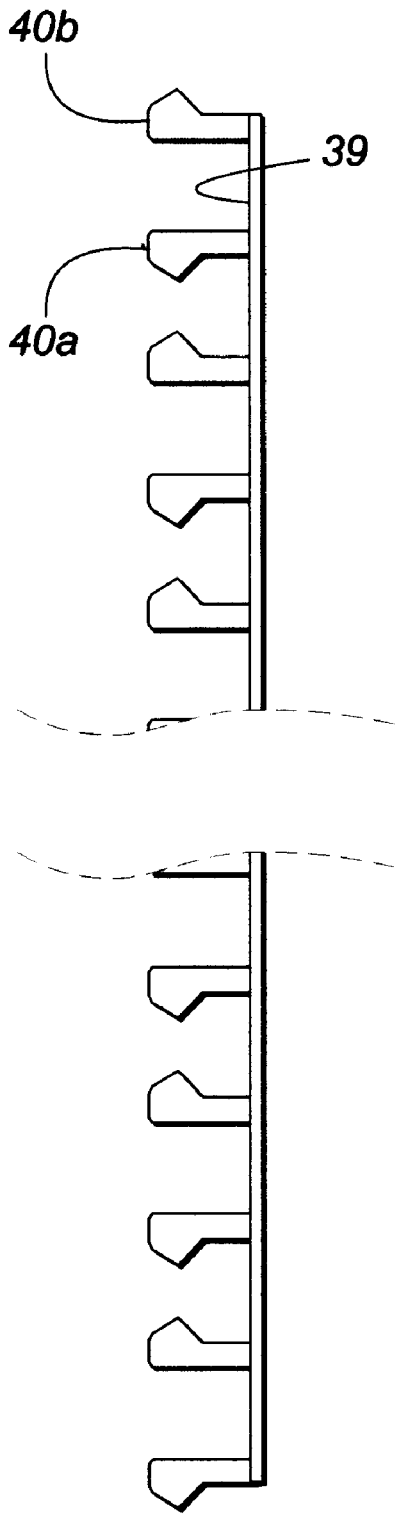
Figure 3D:
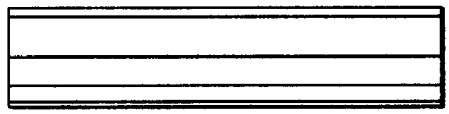
FIG. 3D is an end view of the intermediate mounting clip shown in FIGS. 3A–3C.

FIGS. 3A, 3B, and 3C, show detailed views of the intermediate clip 17 according to a first embodiment. That intermediate clip contains multiple groups of clip modules 35 each having a pair of prongs 40*a*, 40*b*, extending outwardly from a base 39, each of which may be substantially as described for the corresponding elements of the multiple end clips 15 and 16. Each base 39 may include a hole for mounting the multiple intermediate clip 17 on a wall or other support surface. However, the multiple intermediate clip 17 lacks a side trim or other structural member analogous to the side trims 37 of the multiple end clips. In that way, the multiple intermediate clip 17 is configured to receive ends of sign plates from either side as in FIG. 1A, and can split a sign into two columns containing sign plates of different widths as shown in FIG. 1B.

Figure 1B:
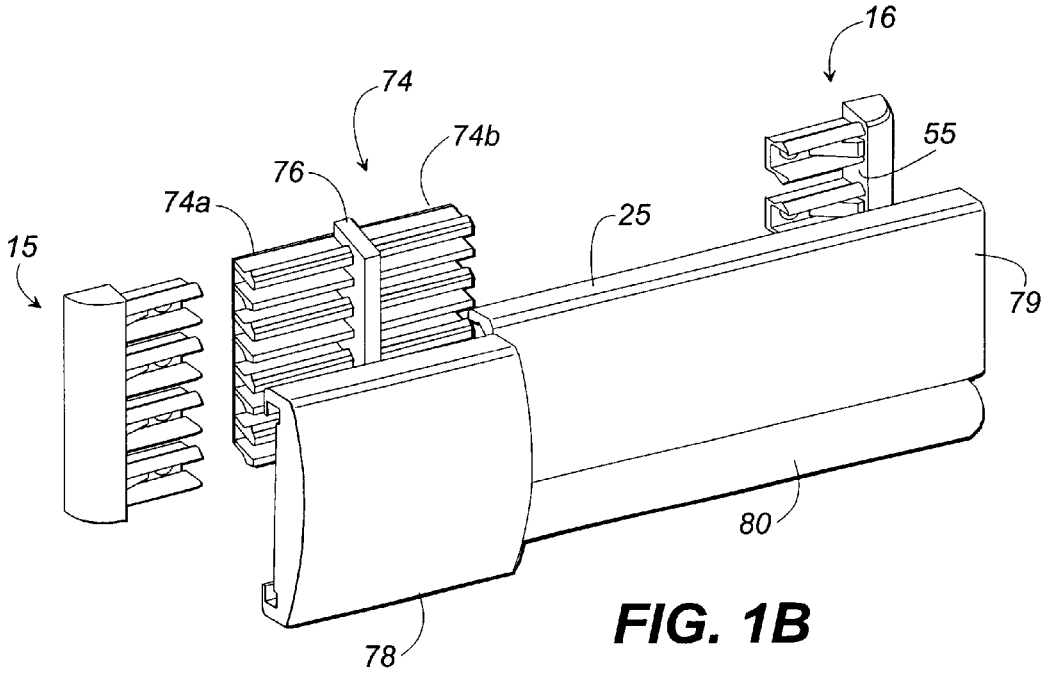
FIG. 1B is an exploded fragmentary view showing a directory sign according to a second modification of the embodiment in FIG. 1.

FIG. 1B shows a second embodiment of multiple intermediate clip 74 according to the invention. A divider barrier 76 extends across the intermediate clip 74 intermediate its longitudinal ends, defining two multiple intermediate clips 74*a* and 74*b*. The barrier 76 extends across the width of the multiple intermediate clip 74 and extends outwardly beyond the sides and outer ends of the prongs associated with the intermediate clip. The outermost extent of the barrier 76 extends beyond the front surface and flanges of the sign plates 78 and 79 in the assembled sign and provides a visible separator between mutually-facing ends of the two sign plates 78 and 79 attached to the multiple intermediate clips 74*a*, 74*b* between the end clips 15 and 16. The lower sign plate 17 in FIG. 1B has a decorative bar 80 along its lower side. The barrier 76 thus provides a finished appearance to a sign as shown in FIG. 1B, composed of different kinds of sign plates having dissimilar widths or contours.

Figure 4:
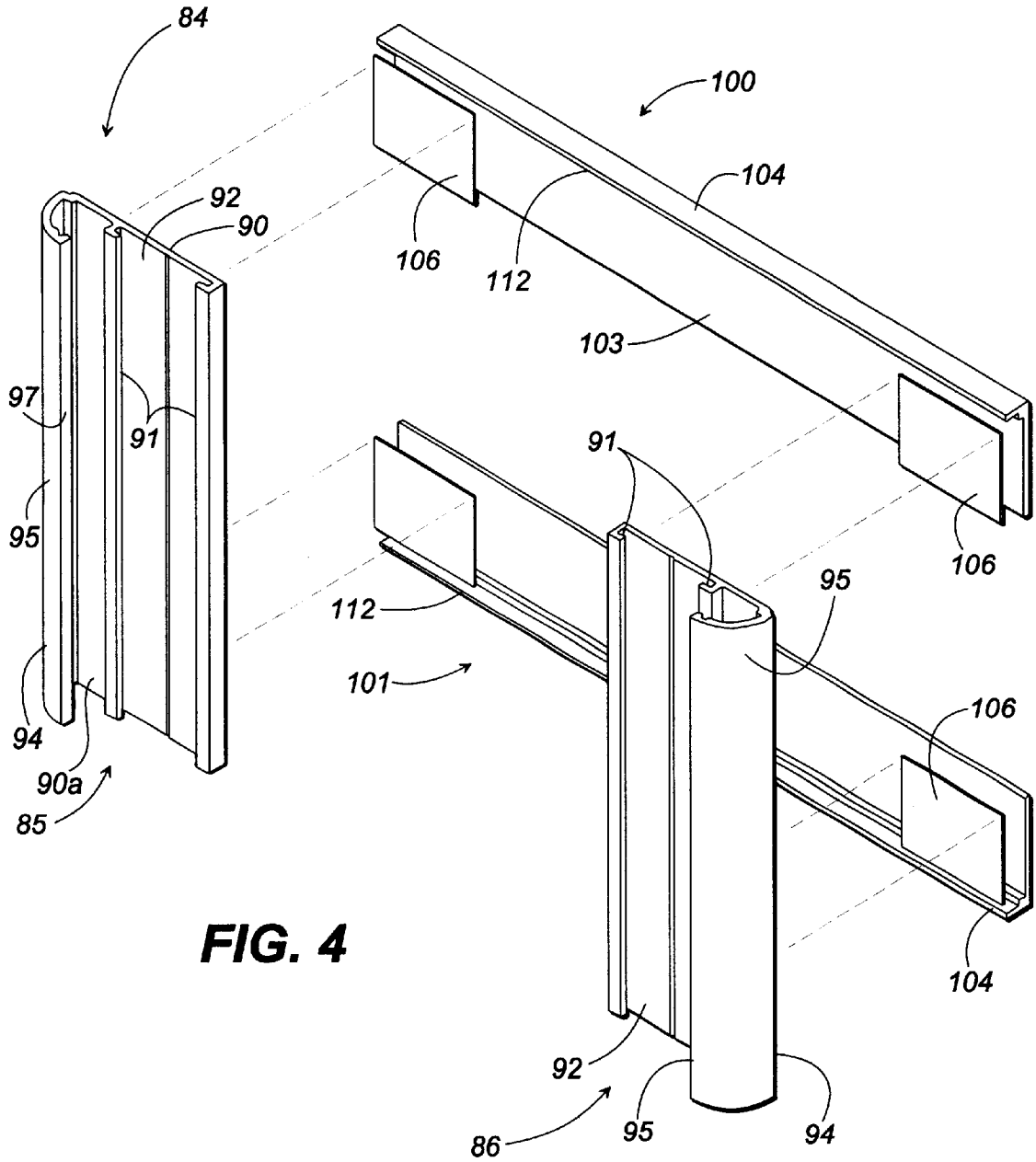
FIG. 4 is an exploded isometric view showing frame elements of a sign according to another embodiment of the invention.
Figure 5:
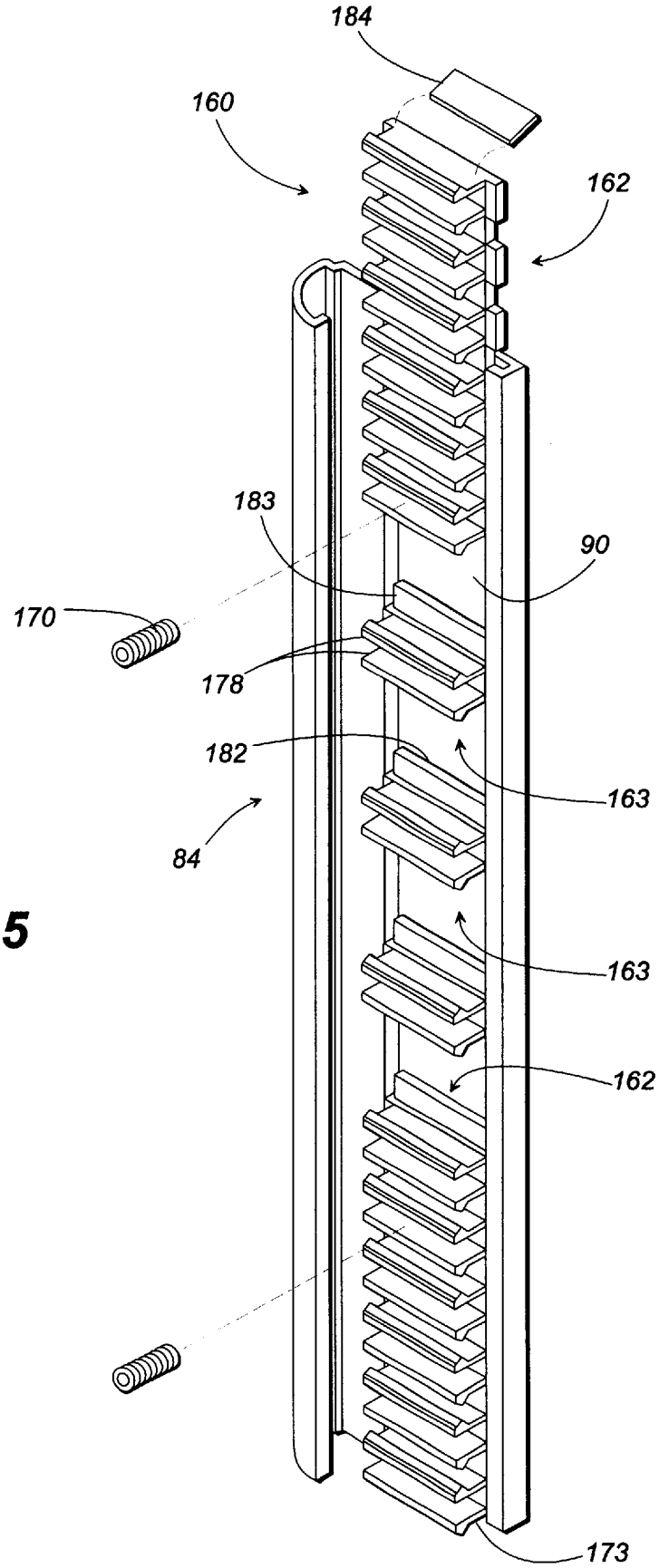
FIG. 5 is a pictorial view showing a side track of the embodiment shown in FIG. 4, including an assembly of clips and illustrating a typical assembly for that embodiment.

FIG. 4 shows an exploded view of a sign 84 according to another disclosed embodiment of the present invention. The sign 84 includes a left side track 85 and a right side track 86 each receiving separate assemblies of multiple clips as shown in FIG. 5, in place of the multiple end clips 15 and 16 for the embodiments discussed above. The multiple clip assemblies are supported by the side tracks 85 and 86, which in turn support sign plates (not shown) such as the sign plates 1113, 78, and 79 described above.

The side tracks 85 and 86 are identical and preferably are extruded or otherwise formed as unitary members. Each side track includes a back portion 90 with a front surface 90*a* from which a pair of L-shaped flanges 91 extend forwardly to form a channel 92 extending the length of the side track. A side portion 94 also extends the length of the side track along one side of the back portion. The side portion 94 includes a trim element 95 projecting forwardly from one longitudinal edge of the back portion 90 and extending over part of the front surface 90*a* to end at an inner face 97 overlapping part of the longitudinal edge. The inner face 97 is dimensioned to overlay and cover the ends of sign plates installed on the sign 84, as described below.

The rectangular frame comprising sign 84 also includes the top closure 100 and the bottom closure 101, respectively spanning the upper and lower ends of the side tracks 85 and 86. The top closure 100 has a flat backplate 103, longitudinal ends of which are affixed to upper ends of the back portions 90 of the respective side tracks. The bottom closure 101 preferably is identical to the top closure, and likewise interconnects with the lower ends of the side tracks. Lips 104 extend forwardly from the upper edge of the top closure 100 and from the lower edge of the bottom closure 101. Double-sided adhesive strips 106 are interposed between overlapping areas of the back portion 90 on the side tracks and the confronting forward surface of each backplate 103, joining together the side tracks and closures to form a rigid rectangular frame of fixed shape. Other suitable fastening techniques can interconnect the side tracks and closures.

Figure 5A:
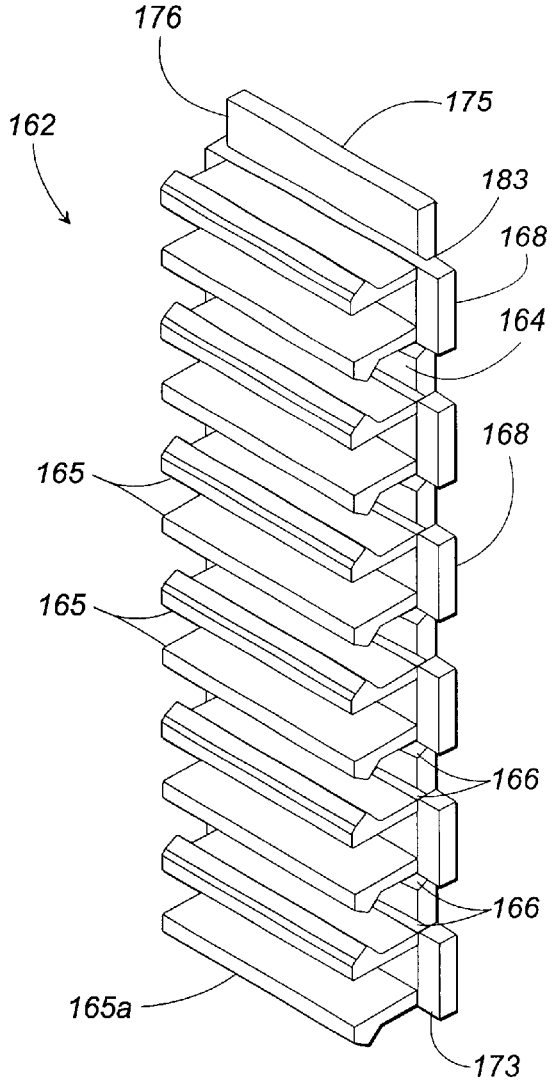
FIGS. 5A, 5B, and 5C respectively are pictorial, front, and side views of a typical clip in the embodiment of FIG. 5.
Figure 5B:
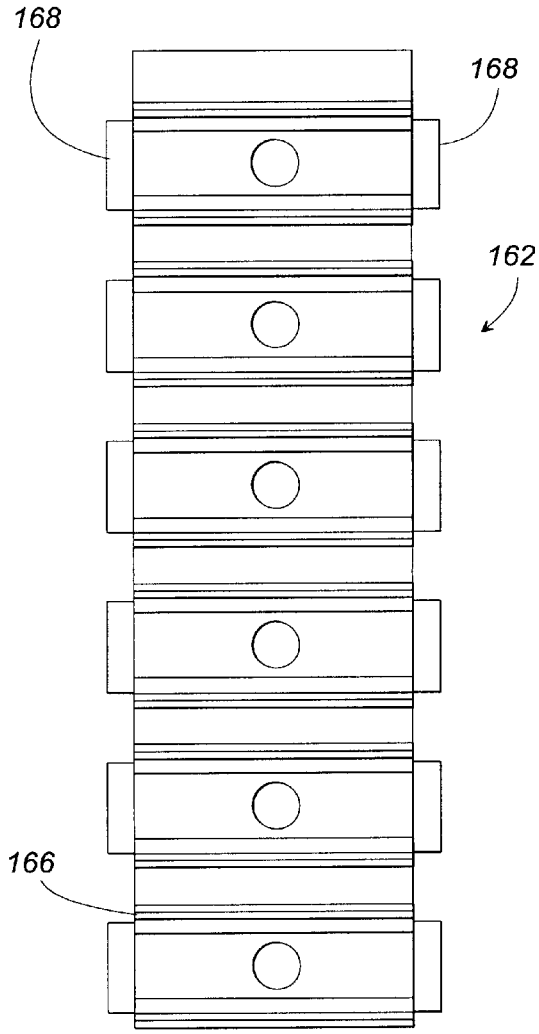
Figure 5C:
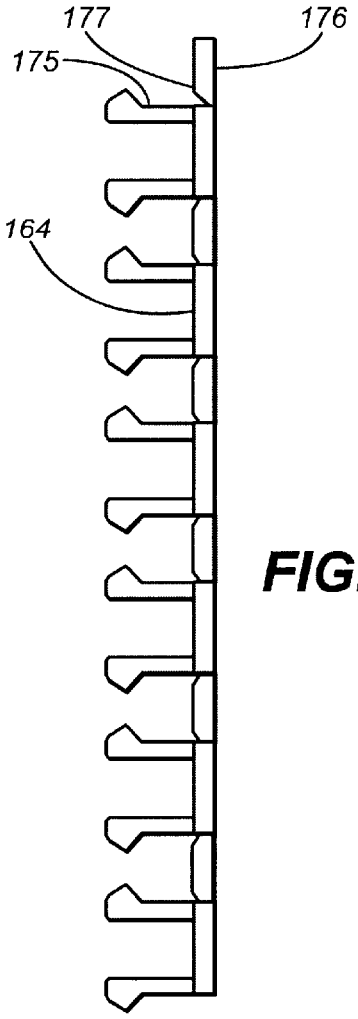

The channel 92 of each side track 85 and 86 receives a multiple clip assembly 160 shown in FIG. 5. Each multiple clip assembly 106 combines one or more multiple clips 162, with one or more filler clips 163 added as needed at the top of each multiple clip. Referring to FIGS. 5A and 5B, each multiple clip 162 has a base 164 from which multiple pairs of prongs 165 extend outwardly to support sign plates flush with the trim element 95 (FIG. 4) of the adjacent side track. Between each pair of prongs 165, the base 164 is somewhat longer than the length of the prongs so that the base extends outwardly beyond each prong to form fingers 168 along both sides of the multiple clip 160. Those fingers fit within and engage the flanges 91 on the back portions 90 of the side tracks as the multiple clip is inserted in the channel 92, so that the fingers 168 retain the multiple clips within the channels. The multiple clips 162 may be secured within the channels 92 by fasteners such as self-threading setscrews 170 (FIG. 5) or the like inserted through holes in the base of the clip to engage the back portion 90, allowing for future removal of the multiple clips; or by crimping the inside and outside flanges 91 at the top and bottom of the channel for permanent retention of the multiple clips.

A narrow channel or groove 166 is formed in the upper side of each base 164, at the roots of facing prongs for each adjacent pair of prongs 165. These grooves 166 extend from side to side across the bases and relieve stress in the multiple clip assembly for improved flatness of the assembly.

The overall length of each multiple clip 162 comprising the multiple clip assembly 160 typically is a fraction of the length of the channel 92. A typical multiple clip assembly 160 as shown in FIG. 5 thus has two or more multiple clips 162 occupying the channel 92. The lower end 173 of each clip assembly 160, as seen in FIG. 5, is flat without extending laterally beyond the lowermost prong 165*a*. However, the upper end 175 of the multiple clip 162 has a spacer tab 176 connected to the uppermost base 164 by a region 177 of predetermined structural weakness.

Figure 5D:
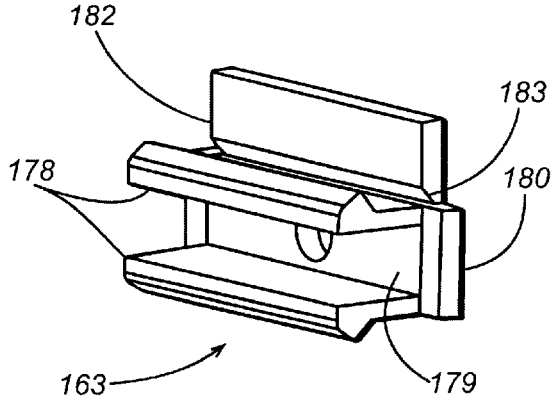
FIG. 5D is a pictorial view of a typical filler clip in the embodiment of FIG. 5.

The lower end 173 of the bottom multiple clip is flush with the lower end of the channel 92, as seen in FIG. 5, and additional multiple clips are stacked on the lowermost multiple clip to occupy the length of the channel. If the channel length is between the combined lengths of available multiple clips 162, one or more filler clips 163 is placed between upper and lower multiple clips in the channel. Each filler clip 163, as shown in FIG. 5D, has a single pair of prongs 178 extending outwardly from a base 179 having side fingers 180 corresponding to the fingers 168 of the multiple clips 162. A spacer tab 182 is connected to the upper side of the base 179 by a region 183 of predetermined structural weakness. The spacer tabs of the multiple clips and spacer clips, which are substantially the same width as the base 164 between adjacent pairs of prongs 165, engage the flat lower end 173 of each upper clip in a multiple clip assembly 160 so as to maintain proper spacing of the prongs in adjacent multiple clips 162 along the assembly. The weakened region 177 permits easy removal of the spacer tab from the uppermost multiple clip in the assembly, as shown at 184 in FIG. 5, so that the upper end of that multiple clip is flush with the top of the channel 92.

Once the multiple clip assembly 160 is in place within the channels 92 on both sides of a sign assembly, the top and bottom closures 100 and 101 are attached to the back of each side track as previously described, so that the edge lips 104 extend over the upper and lower ends of the channels 92. The edge lips 104 also retain the multiple clip assembly within the channels 92 of the left and right side tracks. The resulting sign 84 now is ready to receive sign plates as described herein, with the side flanges of each sign plate engaging the prongs of the multiple clip assemblies retained in the side tracks 85 and 86.

As previously mentioned, the inner face 97 of each trim element 95 overlies the ends of the installed sign plates, providing an attractive aesthetic appearance to the overall sign and preventing tampering of the sign plates. The edge lips 104 of the top and bottom closures 100 and 101 at the upper and lower ends of the sign plate 85 are contiguous to a flange 25 of the sign plates at those sides. The width of each edge lip 104 is chosen so that the outer edge 112 abuts the back edge 27 of the confronting sign plate flange 25, thereby closing the upper and lower ends of the assembled sign. The edge lips 104 of the top and bottom closures thus allow using any available sign plate according to the present invention, having flanges 25 of equal depth on both sides, at the uppermost or lowermost positions as well as at intermediate positions on the sign.

Figure 6:
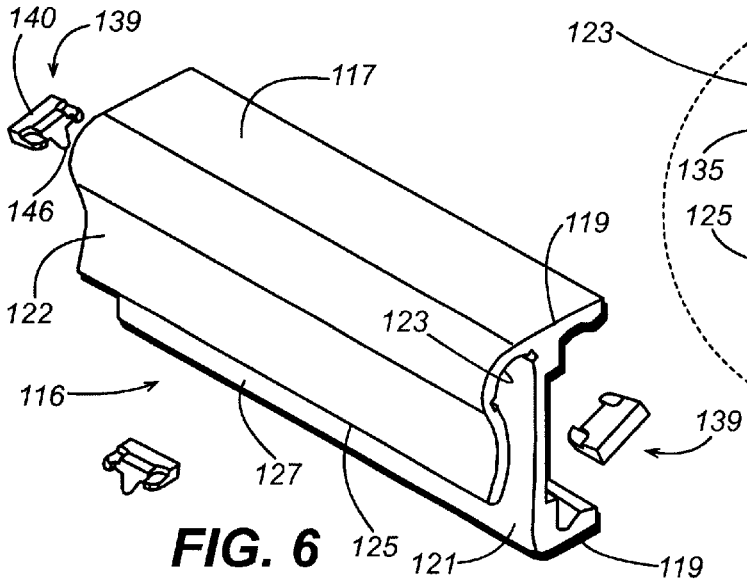
FIG. 6 and FIG. 6A are a pictorial view and an enlarged end view of a noteholder according to another embodiment of the present invention and selectively attachable to the mounting clips shown in the embodiments of FIGS. 1 and 3.
Figure 6A:
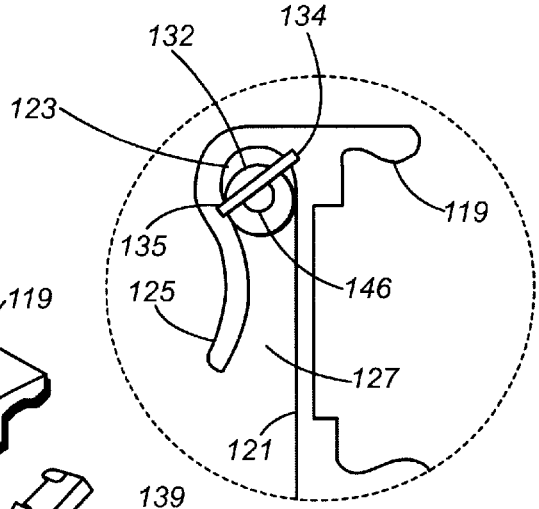
Figure 7:
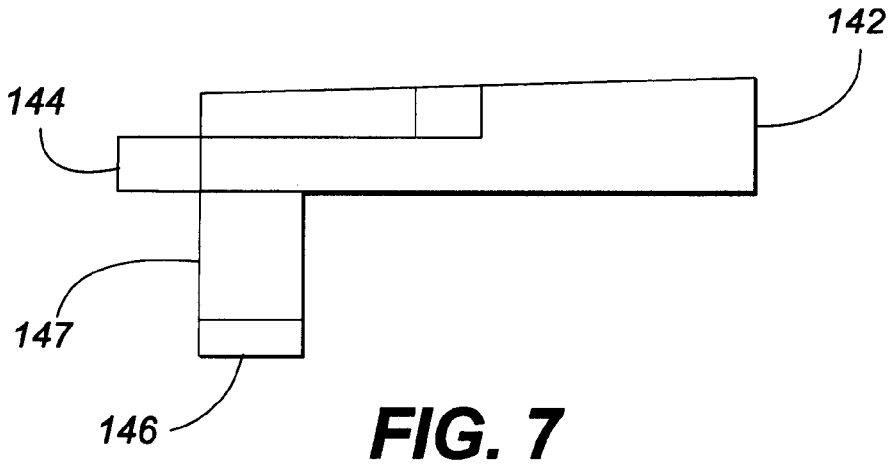
FIG. 7 is an enlarged side view of the noteholder in the embodiment shown in FIG. 7.
Figure 8:
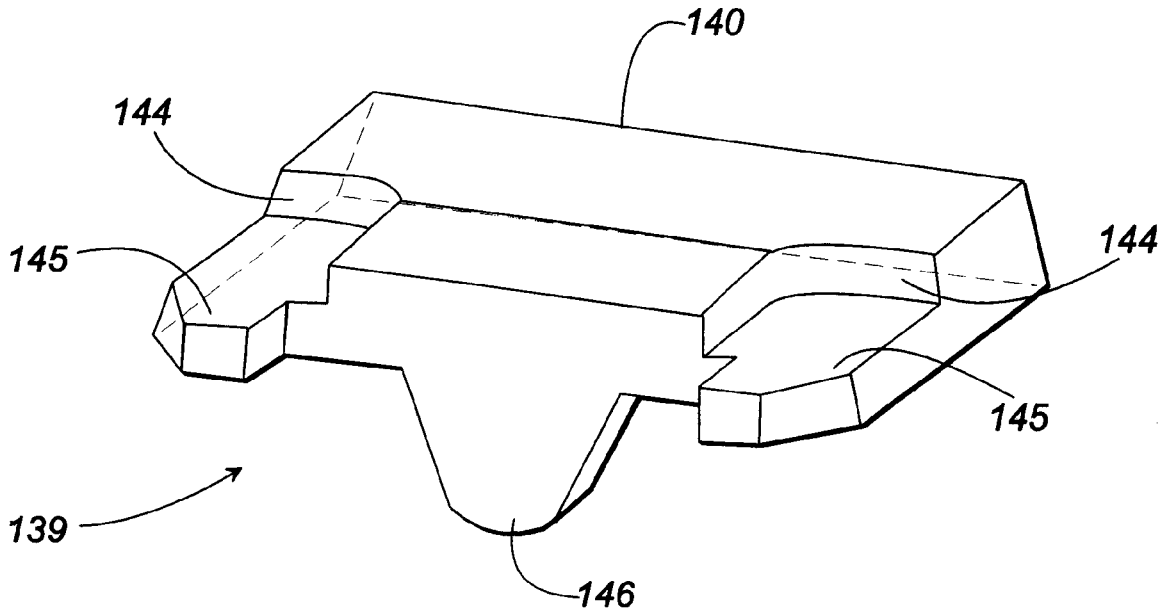
FIG. 8 is a pictorial view of the roller stop in FIG. 6

FIG. 6 and FIG. 6A show a message holder 116 configured for attachment to a sign according to the present invention and functioning as another embodiment of sign plate according to the present invention. The message holder 116 includes an elongate housing 117 with a pair of flanges 119 extending rearwardly for engagement with prongs of a multiple clip, as described above with respect to the sign plates 11–13. The top of the housing 117 extends forwardly from the front surface 121 of the housing to form a lip 122 curving out in front of that flat surface and defining a generally cylindrical channel 123. That forwardly-extending portion of the housing terminates at an outer edge 125 flared outwardly from the front surface 121, so that the space between the lower edge 125 and the front surface defines an open channel 127 through which a message sheet may be inserted.

A cylindrical element such as one or several rollers 132 loosely fits within the channel 123 to hold papers notes or messages in place within that channel, in a manner known in the art. Heretofore, such rollers were retained in the channel by inserting a full end cap into each end of the channel, or by drilling a hole through the lip 122 near each end of the message holder and forcing a small-diameter roll pin or the like through the hole to extend across the channel 123, thereby capturing the roller 123 between the pins. That latter arrangement requires securing the message holder while the two holes are drilled through the outer edge of the lip 122, and then inserting the relatively small-diameter pins through those holes, those steps being relatively painstaking due to the small diameters of the pins and the corresponding holes.

The present invention avoids the necessity of drilling the holes or fitting pins within those holes. Referring to the enlarged portion of FIG. 6A, a first slot 134 is extruded or otherwise formed into the cylindrical surface forming the channel 123, along the upper portion of that channel at each end of the housing. A second slot 135 is formed along the inner surface of the lip 122, spaced apart from the first slot 134 across the channel 132. Once the roller or rollers 132 are positioned within the channel 123, roller stops 139 are inserted in the slots 134 and 135 on the housing 117 at both ends of the channel 123, to retain the roller in place. Each roller stop 139 in the preferred embodiment has a flat and approximately rectangular body tapered for increasing thickness from the front end 141 to the back end 142, to provide a wedge fit into the slots 134 and 135. The sides 143*a* and 143*b* are tapered inwardly from bottom to top of the body 140, providing a wedge shape from side to side of the body. The front comers of the body 140 are cut away as shown at 144, providing shoulders 145 at the front of the body to assist in inserting the roller stops into the slots. A finger 146 extends downwardly from the front 141 of the body. The front surface 147 of each finger 146 faces an end of the adjacent roller 132 in the channel 132 and helps prevent that roller from becoming wedged on the front end 141 of the roller stop.

It should be understood that the foregoing relates only to a preferred embodiment of the present invention, and that numerous changes and modifications therein may be made without departing from the spirit and scope of the invention as defined in the following claims.

What is claimed is:

1. Sign apparatus comprising:

a pair of end clips supported in mutually spaced apart relation;

at least one sign plate removably attached to the end clips;

the sign plate having a front element for supporting indicia and having an underside, and further having a pair of side elements of equal depth extending back from the front element;

each end clip having plural clip modules, with each clip module having a base and a pair of mutually spaced-apart attachment elements extending from the base to engage side (elements of a sign plate attached to the end clips;

each attachment element having a distal end spaced apart from the base and positioned to contact a predetermined location on the sign plate, thereby defining a predetermined elevation of the sign plate relative to the base of each end clip;

each side element of the sign plate extending back from the front element to conceal the attachment elements and the bases of the end clips in the sign apparatus, whereby the side elements substantially conceal from view the bases and the clip modules of the end clips;

the front element of the sign plate comprising a channel for inserting a message sheet;

an element loosely received within the channel and operative to selectively engage a message sheet to be inserted in the channel, the channel being open at least at one end to permit inserting the element;

a slot formed in the sign plate at the one end of the channel to extend inwardly from and in communication with the open end; and a stop selectively received in the slot from the open end and extending across the open end to retain the element within the channel.

* * * * *